US005213407A

United States Patent [19]

Eisenbraun

[11] Patent Number: 5,213,407

[45] Date of Patent: May 25, 1993

[54] MINATURE CHRISTMAS TREE PLATFORM AND LIGHT STRING UNIT

[75] Inventor: Kenneth D. Eisenbraun, Birmingham, Mich.

[73] Assignee: Eisenbraun Reiss Inc., Troy, Mich.

[21] Appl. No.: 871,063

[22] Filed: Apr. 20, 1992

[51] Int. Cl.[5] ..... F21P 1/02

[52] U.S. Cl. ..... 362/123; 362/86; 362/184; 362/800

[58] Field of Search ..... 362/86, 123, 184, 800

[56] References Cited

U.S. PATENT DOCUMENTS

| | | | |
|---|---|---|---|
| 2,568,995 | 9/1951 | Eckhardt | 362/86 |
| 3,035,163 | 5/1962 | Paumgardhen | 362/123 |
| 3,571,586 | 3/1971 | Duckworth | 362/123 |
| 3,614,528 | 10/1971 | Craddock | 362/123 |

*Primary Examiner*—Carroll B. Dority

*Attorney, Agent, or Firm*—Krass & Young

[57] ABSTRACT

A combination platform and light string unit for use with a miniature or table-top Christmas tree. In an alternative embodiment, a musical unit is included within the platform to play holiday music.

10 Claims, 2 Drawing Sheets

MINATURE CHRISTMAS TREE PLATFORM AND LIGHT STRING UNIT

BACKGROUND OF THE INVENTION

1. Field of the Invention

This invention relates generally to the field of decorative lighting devices and more particularly to a combination platform and light string unit for use with a miniature Christmas tree.

2. Description of the Related Prior Art

In small display areas, miniature Christmas trees are a popular alternative to a full-sized tree. However one drawback of miniature Christmas trees which use light strings as decorations is concealing the power cord from view. This is especially problematic if it is desired to display the Christmas tree in an area that is distant from an electrical outlet. Furthermore, the size of bulb employed by most prior art light strings is too large for use on a miniature Christmas tree.

Accordingly, it would be useful, convenient, and decoratively-pleasing to have a combination platform and light string unit for use with a miniature Christmas tree to alleviate the aforementioned problems.

SUMMARY OF THE INVENTION

The present invention is a combination platform and light string unit for use with a miniature or table-top Christmas tree. The light string component is attached to and extends from the platform component such that when a miniature Christmas tree is placed upon the platform, the light string may be wrapped around the branches of the tree. The platform component elevates or stabilizes the base of the miniature Christmas tree and houses the power supply for the attached light string. Thus, unsightly and dangling extension cords which limit the placement of the tree to an area near an electrical outlet are eliminated. In an alternative embodiment, the platform component may additionally include a musical unit comprising a digital electronic playback module and an audio synthesizer which operate in conjunction to play holiday music.

BRIEF DESCRIPTION OF THE DRAWINGS

Other objects and advantages of the invention will become apparent upon reading the following detailed description and upon reference to the drawings, in which.

DETAILED DESCRIPTION OF THE INVENTION

Figure 1:
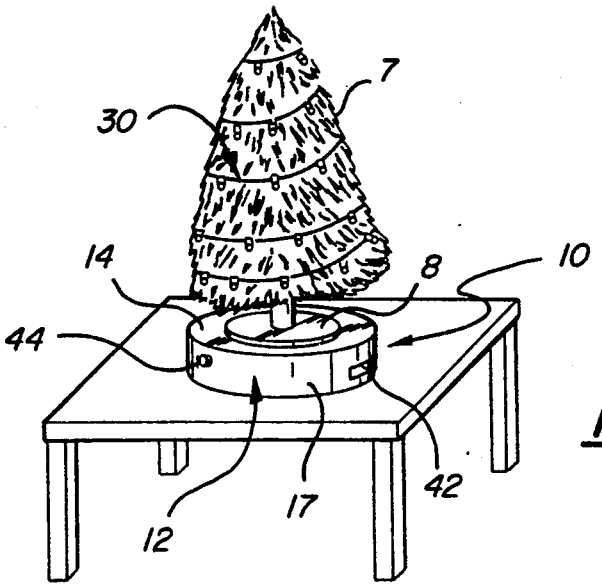
FIG. 1 is a perspective view of an embodiment of a combination platform and light string unit in use with a miniature Christmas tree, said embodiment being constructed in accord with the teachings of the present invention.

Referring now to the drawings, there is depicted in FIG. 1 a combination platform and light string unit 10 in use with a miniature Christmas tree 7 having a base 8 attached to the trunk of the tree 7.

The combination platform and light string unit 10 comprises a platform 12 having a light string 30 connected to and extending from the platform 12. The platform 12 has an upper surface 14, a lower surface 16 (best shown in FIG. 2) and at least one side surface 17. The upper surface 14 and the lower surface 16 of said platform 12 lie in substantially parallel planes which are separated from one another and connected by the side surface 17. The upper surface 14 may be substantially planar as shown in FIG. 1. In an alternative embodiment (not shown), the upper surface 14 may further include an indentation configured to support upright the trunk of a miniature Christmas tree 7 that does not have a base component 8 In the preferred embodiment, the platform 12 is constructed of sturdy plastic. However, other rigid materials such as wood or metal which are capable of retaining a formed shape would be equally applicable.

The number of side surfaces 17 depends upon the shape of the platform 12. For example, if the platform 12 is circular in shape, then only one side surface 17 is required to enclose the platform 12. However, if the platform is square or rectangular, four side surfaces 17 may be required to enclose the platform 12. While it is preferred that the platform 12 be completely enclosed, embodiments are envisioned which eliminate the lower surface 16 such that the platform 12 is supported solely by the edges of the side surface(s) 17.

In general, the height of the side surface 17 determines the overall height of the platform 12, although varying the width of the upper surface 14 and/or the width of the lower surface 16 would also vary the platform's 12 height. Accordingly, the height of the platform 12 may be varied so that different elevational levels may be achieved using the teaching of the present invention.

Figure 2:
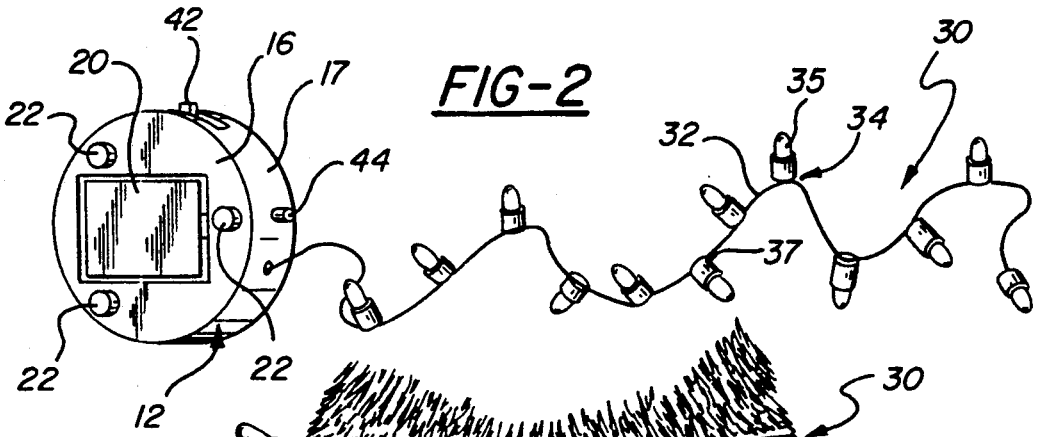
FIG. 2 is a bottom plan view of an embodiment of the present invention.
Figure 3:
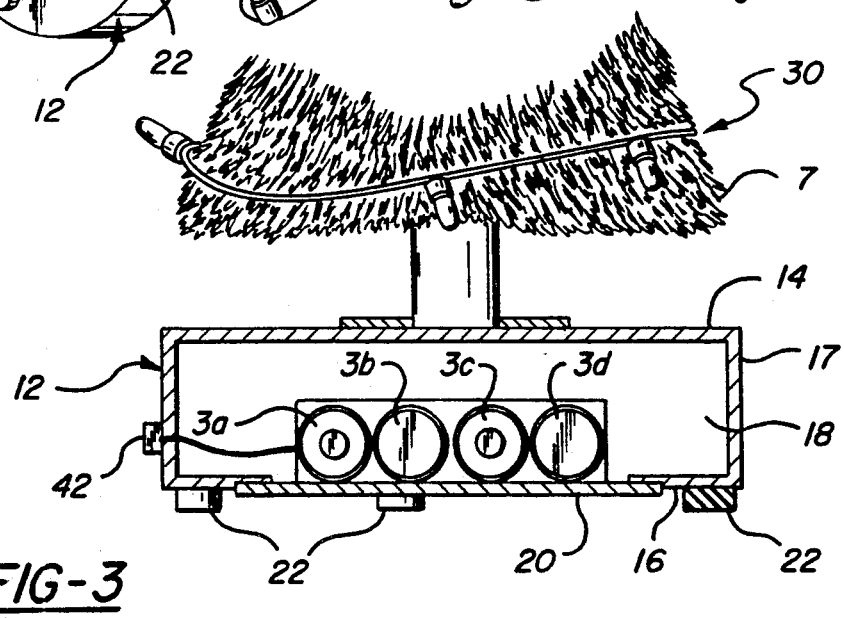
FIG. 3 is a cross-sectional view of an embodiment of the present invention.

As shown in FIGS. 2 and 3, the lower surface 16 of the platform 12 further includes a plurality of resilient elastic feet 22 to prevent the platform and light string unit 10 from slipping or scratching the table-top or other surface upon which it is placed. The elastic feet 22 may be constructed from rubber, foam, or other similar materials and are fastened to said lower surface 16 with an adhesive.

The platform 12 further includes a power supply compartment 18. In the preferred embodiment, the platform 12 is completely enclosed on all sides and the power supply compartment 18 is integrally formed within the platform 12. The power supply compartment 18 is accessible by the removal of a cover plate 20, said cover plate 20 being located within the lower surface 16 of said platform 12 such that said cover plate 20 is substantially flush with the lower surface 16 when positioned therein. As shown in FIG. 3, the power supply compartment 18 is configured to receive at least one battery; in the preferred embodiment, the power supply compartment 18 is configured to receive four size AA batteries 3*a*,3*b*,3*c*,3*d*.

Figure 4:
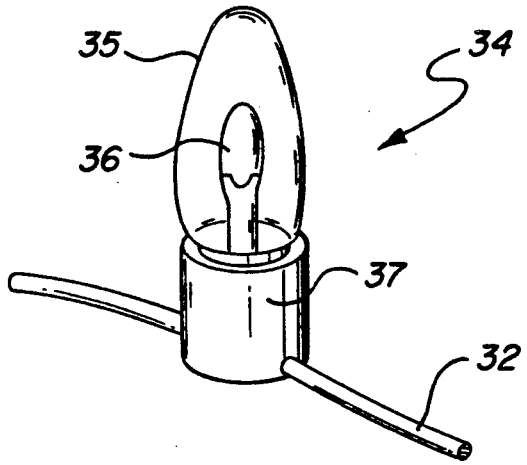
FIG. 4 is an enlarged view of an embodiment of a light-emitting element of the present invention.

A light string 30 is connected to and extends from the platform 12. The light string 30 comprises a plurality of light-emitting elements 34 disposed intermittently along a flexible wire 32. The light-emitting elements 34 may be light-emitting diodes (LED), gaseous or conventional incandescent light bulbs. In the preferred embodiment shown in FIG. 4, the light-emitting elements 34 each include a light-emitting diode 36 and a decorative transparent or translucent cover 35 attached to the flexible wire 32 by a base unit 37. The decorative cover 35 is shaped to give the appearance of a miniature Christmas tree bulb.

In addition, the platform 12 has a power switch 42, preferably mounted upon the side surface 17 of the platform 12. The power switch 42 is in electrical communication with the power supply compartment 18 which, in turn, is in electrical communication with the light string 30 such that when said power switch 42 is activated, the light string 30 is illuminated in one of a variety of illuminating modes. The power switch 42 is multi-positioned such that one of a plurality of different illuminating modes may be selected at the user's option In one illuminating mode, the light-emitting elements 34 of the light string 30 are constantly illuminated. In another illuminating mode, various light-emitting elements 34 flash on and off at periodic time intervals.

An input jack 44 for connection with a voltage adapter, as an alternative to batteries is also mounted on the side surface 17 of the platform 12. The input jack 44 is wired to the light string 30 via the power supply compartment 18. Thus, although batteries are the preferred source of power, the user has the option of using electricity routed from an electrical outlet to illuminate the light string 30 of the platform and light string unit 10.

Figure 5:
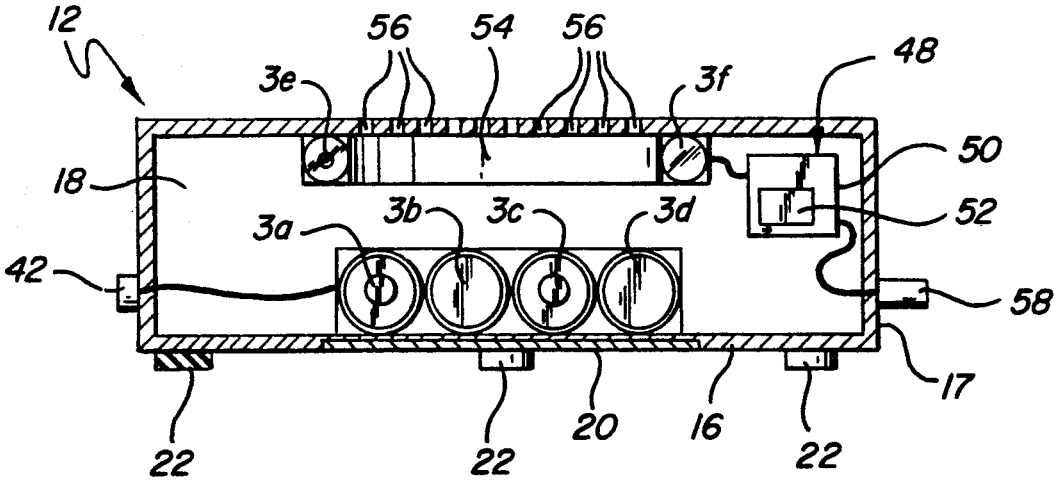
FIG. 5 is a cross-sectional view of an alternative embodiment of the present invention including a musical unit.

In an alternative embodiment shown in FIG. 5, the platform 12 additionally includes a musical unit 48 having a digital electronic playback module 50 and an audio synthesizer 54 disposed within the power supply compartment 18. The musical unit 48 is powered by batteries *3e, 3f* which are also disposed in the power supply compartment 18. Preferably, two AAA batteries *3e, 3f* are used to power the musical unit 48.

The digital electronic playback module 50 of the musical unit 48 contains a read only memory (ROM) microchip 52 programmed with the pattern of ones and zeros necessary to play one or more holiday musical selections. The audio synthesizer 54, in electrical communication with the digital electronic playback module 50, emits the musical selections through a plurality of apertures 56 in the platform 12. In alternative embodiments, the apertures 56 may be eliminated. An activating switch 58, such as an on/off push button, is preferably mounted upon the side surface 17 of the platform 12. The activating switch 58 is in electrical communication with the musical unit 48 but not the light string 30. Accordingly, the light string 30 may be illuminated without activating the musical unit 48 and vice versa; likewise, both the light string 30 and the musical unit 48 may be operated simultaneously. In an alternative arrangement, the batteries *3a, 3b, 3c, 3d, 3e, 3f* may be connected in parallel such that if the batteries *3e, 3f* powering the musical unit 48 die, the light string 30 will continue to be illuminated.

Thus it is apparent that there has been provided, in accordance with the invention, a combination platform and light string unit 10 for use with a miniature or tabletop Christmas tree 7. While the invention has been described in conjunction with specific embodiments thereof, it is evident that many alternatives, modifications, and variations will be apparent to those skilled in the art in light of the foregoing description. Accordingly, the present invention is intended to embrace all such alternatives, modifications, and variations as falling within the spirit and broad scope of the claims.

I therefore claim:

1. A combination platform and light string unit for use with a miniature Christmas tree, said unit comprising:

a rigid platform configured to support and to elevate said Christmas tree, said platform having an upper surface, a lower surface opposed to and lying in a plane substantially parallel to the upper surface, and at least one side surface disposed between and connecting said upper and lower surfaces;

a power supply compartment integrally formed within said platform, said compartment being accessible via a removable cover plate, said cover plate when positioned within said platform being substantially flush with said lower surface;

an input jack for connection with a voltage adapter disposed upon said side surface of said platform and capable of electrical communication with said power supply compartment;

a plurality of resilient elastic feet disposed on said lower surface of said platform;

a light string connected to and extending from said platform, said light string comprising a plurality of light-emitting elements disposed intermittently along a flexible wire;

a power supply for illuminating said light string, said power supply being in electrical communication with said flexible wire and said power supply compartment; and a multi-positioned power switch mounted on said platform for controlling said power supply in a selected one of a plurality of different illuminating modes wherein one of said plurality of illuminating modes flashes various ones of said plurality of light-emitting elements on and off at periodic time intervals and another of said plurality of illuminating modes maintains said light-emitting elements constantly on, whereby said miniature Christmas tree is positioned upon said upper surface of said platform and said light string is wrapped around or otherwise arranged relative to said Christmas tree and the power switch is positioned in one of said illuminating modes thus causing the illumination of said light-emitting elements.

2. The device of claim 1 wherein said power supply compartment is configured to receive batteries.

3. The device of claim 2 wherein said power supply is batteries.

4. The device of claim 1 wherein said power supply is electricity routed through an electrical outlet via said input jack.

5. The device of claim 1 wherein said light-emitting elements are light-emitting diodes (LED).

6. The device of claim 5 further comprising a plurality of decorative covers in the shape of miniature Christmas tree bulbs, each of said covers encasing one of said light-emitting diodes.

7. The device of claim 1 wherein said light-emitting elements are incandescent light bulbs.

8. The device of claim 1 further comprising a musical unit comprising:

a digital electronic playback module in electrical communication with said power supply, said module including a read only memory (ROM) microchip, said microchip instructed to play music;

an audio synthesizer in electrical communication with said module, said synthesizer and module being disposed within said power supply compartment; and an activating switch mounted upon said side surface of said platform in electrical communication with said module and synthesizer whereby activating said switch causes the module and synthesizer to operate in conjunction to emit music through said apertures.

9. The device of claim 8 further comprising a plurality of apertures through said platform, said apertures proximate to said synthesizer whereby activating said switch causes the module and synthesizer to operate in conjunction to emit music through said apertures.

10. The device of claim 8 wherein said musical unit and said light string are not in electrical communication with one another.

* * * * *